United States Patent [19]

Miyashita

[11] 3,951,650

[45] Apr. 20, 1976

[54] LOW CARBON, NI-CR-MO SYSTEM CAST IRON ROLL

[75] Inventor: Kakunosuke Miyashita, Tokyo, Japan

[73] Assignee: Hitachi Metals, Ltd., Japan

[22] Filed: June 9, 1975

[21] Appl. No.: 584,823

[30] Foreign Application Priority Data

June 12, 1974 Japan ..... 49-66104

[52] U.S. Cl. ..... 75/128 D; 75/123 CB; 75/128 W; 148/35

[51] Int. Cl.[2] ..... C22C 38/22; C22C 38/36

[58] Field of Search ..... 75/128 DW, 123 CB; 29/148.4 D; 148/35

[56] References Cited

UNITED STATES PATENTS

| | | | |
|---|---|---|---|
| 1,948,246 | 2/1934 | Seaman | 148/35 |
| 1,988,910 | 1/1935 | Merica | 148/35 |
| 2,516,524 | 7/1950 | Millis | 75/123 CB |

*Primary Examiner*—L. Dewayne Rutledge
*Assistant Examiner*—Arthur J. Steiner
*Attorney, Agent, or Firm*—Craig & Antonelli

[57] ABSTRACT

A low carbon, Ni-Cr-Mo system cast iron roll containing, in weight percent, from 1.5 to 2.8% C, from 0.2 to 0.7% Si, from 0.6 to 0.8% Mn, from 2.1 to 3.5% Ni, from 1.8 to 2.5% Cr, from 1.1 to 1.5% Mo, the balance being essentially Fe and a reasonable amount of impurities. This roll prevents peeling of the top or outermost surface of the roll in the hot rolling, due to the cracking of cementite, and improves the resistance to the surface roughness and wear resistance, thereby improving the efficiency in the rolling operation.

3 Claims, No Drawings

LOW CARBON, NI-CR-MO SYSTEM CAST IRON ROLL

BACKGROUND OF THE INVENTION

This invention relates to a low carbon, Ni-Cr-Mo system cast iron roll for use in the hot rolling of a steel, and more particularly to a roll of the type describes for use in hot finishing-rolling.

Table 1 shows the chemical composition of a conventional cast iron roll for use in hot finishing rolling of steels.

Table 1

| | Chemical composition (%) | | | | | | | |
|---|---|---|---|---|---|---|---|---|
| | C | Si | Mn | P | S | Ni | Cr | Mo |
| Conventional cast iron roll | 3.1 | 0.5 | 0.5 | 0.020 | 0.020 | 4.0 | 0.5 | 0.2 |
| | −3.3 | −1.2 | −0.8 | below | below | −5.0 | −2.0 | −0.3 |

For producing the above listed roll, iron melt having the above listed chemical composition is cast in a metal mold, and then the surface of casting is cooled rapidly, thereby obtaining a fine structure improving wear resistance, while the internal portion and the neck portion of the roll is slowly cooled to thereby produce graphite in a sufficient amount, for the purpose of obtaining softness and withstanding a high stress incurred to the rolling operation. The mechanical properties of a roll are shown in Table 2.

Table 2

| | Roll surface portion | Roll internal and neck portions |
|---|---|---|
| Tensile strength | 30 – 35 kg/mm² | 20 – 22 kg/mm² |
| Hardness (Shore) | 70 – 80 | 35 – 40 |

This type of a cast iron roll undergoes surface roughness and wear within several hours after the beginning of rolling operation, and then becomes no longer usable, so that the roll should be replaced. The operating hours required for replacement corresponds to about 10% of the total operating hours, presenting the most serious problem in the rolling, from viewpoints of efficiency and quality of products.

The outermost surface of the roll in hot rolling reaches temperatures ranging from 600° to 800°C.

Meanwhile, wear incurred to the roll is not a simple wear. More particularly, minute cracks develop in cementite on the surface of a roll and scales are peeled therefrom, so that scales cause friction heat to thereby soften the base iron, resulting in seizure. This then further roughens the surface of a roll and causes wear.

Cementite of 40 to 50%, in volume, is present in the surface of the conventional cast iron roll containing from 3.1 to 3.3% carbon, and is brittle and low in thermal conductivity, thus tending to produce cracking due to change in rolling heat and rolling load, while cementite is insusceptible to friction and to lowering in hardness at an elevated temperature as well as seizure to a hot strip. However, this is not true in the case of hot rolling, as has been described earlier.

On the other hand, the base iron contains from 4.0 to 5.0% Ni in addition to Cr and Mo. This gives Shore hardness of 70 to 80 at a room temperature, while it gives low hardness at an elevated temperature. Particularly at a temperature of 600°C and over, it is rapidly softened, causing surface roughness and wear. However, in a portion deep about 100 microns from the surface of the roll, the temperature is steeply lowered, so that there arises a danger of the mechanical properties of a roll being impaired. In other words, a roll during rolling operation is subjected to flattening under a high rolling load, so that there may not be achieved accurate rolling, because of defects such as bite and buckling which causes hexagonal cracks in the roll surface. In addition, there may arise rupture of the opposite end portions of a roll due to dent and bending which are caused by inclusion of forgein matter such as hard scales and due to impingement of the edge face of a cooled slab.

As has been described, there are confronted many problems with rolls. Thus, it has been long desired to have a roll which meets the following requirements, in combination:

1. Cementite in the top or outermost surface of the roll shall not be subjected to cracking and the resulting peeling.
2. The base iron shall not be softened.
3. There shall be achieved high mechanical properties.

However, an existing cast iron roll fails to meet the aforesaid requirements, because of the high content of carbon, and the fact that nickel is primarily responsible for increasing hardness.

SUMMARY OF THE INVENTION

It is an object of the present invention to provide a cast iron roll containing, in weight percent, from 1.5 to 2.8% C, from 0.2 to 0.7% Si, from 0.6 to 0.8% Mn, from 2.1 to 3.5% Ni, from 1.8 to 2.5% Cr, from 1.1 to 1.5% Mo, the balance being essentially Fe, and a reasonable amount of impurities. It is another object of the present invention to provide a low carbon Ni-Cr-Mo system cast iron roll which is free of cracking cementite in the outermost surface of the roll and the resulting peeling of scales, yet presenting resistance to softening during hot rolling and high mechanical properties.

DESCRIPTION OF THE PREFERRED EMBODIMENTS

The present invention will now be described in detail with reference to the embodiments thereof. Table 3 shows hardness and chemical compositions of cast iron roll according to the present invention and a cast iron roll of the prior art, after subjecting to varying temperatures for one hour, as well as, the hardness when subjected to a repeated cycle of heating at 600°C and cooling.

As can be seen from Table 3, the prior art cast iron roll may maintain hardness of 70 to 78 (Shore) at a room temperature, in the case of Ni being 4.0 to 4.5%, while the hardness is lowered to 65 to 64, when the temperature is in the range of from 500° to 650°C. In addition, the hardness of the prior art cast iron is lowered to 64 (Shore), when subjected to a repeated cycle of heating and cooling (50 cycles) at temperature of 600°C which corresponds to the temperature prevailing in the actual operation.

Table 3

| | Chemical composition (%) | | | | Hardness (Shore) | | | | |
|---|---|---|---|---|---|---|---|---|---|
| | C | Ni | Cr | Mo | As Cast | 500°C | 600°C | 650°C | * |
| Holl according to the present invention | 2.0 | 2.5 | 2.0 | 1.1 | 70 | 72 | 71 | 67 | 68 |
| | 2.0 | 3.0 | 2.0 | 1.2 | 73 | 73 | 72 | 70 | 68 |
| | 2.0 | 3.4 | 2.0 | 1.2 | 75 | 72 | 70 | 68 | 69 |
| Prior art roll | 3.1 | 4.0 | 1.0 | 0.2 | 70 | 65 | 64 | 64 | 64 |
| | 3.2 | 4.5 | 1.0 | 0.2 | 74 | 64 | 64 | 64 | 64 |
| | 3.2 | 4.8 | 1.0 | 0.2 | 78 | 65 | 65 | 64 | 64 |

*650°C — Repeated heating and cooling 50 times

In contrast thereto, the cast iron according to the present invention contains carbon as low as 2.0%, from 2.5 to 3.4 Ni, 2% Cr, and from 1.1 to 1.2% Mo, and thus the hardness is somewhat low at a room temperature such as 70 to 75 in Shore, while the hardness is found to be 67 to 73 at a temperature of 500° to 650°C. In addition, even if the cast iron roll of the present invention is subjected to repeated cycles of heating and cooling (50 cycles) at a temperature of 600°C, the hardness is found to be still high, such as 68 to 69 in Shore.

For obtaining a desired high hardness in the case of the prior art cast iron roll, the addition of carbon and nickel is resorted, so that there results a great amount of cementite, and furthermore a small amount of graphite is distributed due to the addition of Cr and Si for maintaining a desired toughness. In this Mo serves to improve the hardness and toughness. With the cast iron roll according to the present invention, carbon is low in amount, and thus it is free of graphite, resulting in decrease in amount of cementite on the surface of the roll, so that the roll according to the present invention presents an extremely high toughness and is free from peeling due to cracking. The content of Ni is low and Cr is as high as 1.8 to 2.5%, Mo being extremely high. The high hardness is obtained by Ni, Cr and Mo, and the reduction in hardness at an elevated temperature is less and so is wear. The tensile strength is as high as 50 kg/mm$^2$ at the surface of a roll, and its toughness is also high, as compared with those of the prior art cast iron roll.

The background for the contents of the respective elements contained in the roll according to the present invention will be described.

Carbon content should be in the range of 1.5 to 2.8%. Carbon content of at least 1.5% is required for preventing wear and maintaining desired hardness of the roll. If carbon content exceeds 2.8%, then cementite is precipitated in a great amount in the form of a large size grain, thus causing embrittlement as well as cracking plus resulting peeling. So, the upper limit of carbon is set to 2.8%. Carbon content should preferably be in the range of 1.9 to 2.2% and 1.9 to 2.8%.

Silicon content should range from 0.2 to 0.7%. The silicon content of over 0.2% is required for serving as deoxidizer. If the silicon content exceeds 0.7%, then there arises a danger of graphite being produced.

Manganese content is between 0.6% and 0.8%. Like silicon, manganese in required for serving as deoxidizer. If the manganese content is below 0.6%, there tends to be produced cavities. The manganese content of over 0.8% results in defects.

The present invention is based on discoveries that nickel content lower and chrominum and molybdenum contents higher than those of the cast iron roll of the prior art prevent the lowering in hardness at an elevated temperature and reduce wear.

Nickel should present between 2.1 and 3.5%.

Nickel is required for increasing strength and hardness. The nickel content of below 2.1% fails to provide desired strength and hardness, while the content of over 3.5% produces soft austenite, lowering the hardness. The preferable range of nickel is between 2.5 and 3.4%.

Chrominum content is in the range of from 1.8 to 2.5%, preferably from 1.8 to 2.2%.

Chrominum improves the hardness in the hot rolling, as in the cases of Ni and Mo, and further improves wear resistance and resistance to seizure. In this sense, the content of chrominum should be over 1.8%, while the chrominum content of over 2.5% results in too high hardness in the internal portion of a roll, thus causing embrittlement.

Molybdenum content should range from 1.1 to 1.5%. The molybdenum content of below 1.1% lower the hardness in hot rolling, while the molybdenum content of over 1.5% results in embrittlement. The above content should preferably ranges from 1.1 to 1.3%.

As is appparent from the foregoing description of the cast iron roll according to the present invention, desirable stability is afforded to the rolling operation, with the resulting reduction in wear. In addition, there are confronted least defects such as wear, buckling and bite due to a further increase in the rolling load and rolling speed which would be expected in the future. In addition this leads to reduction in cycles of replacement of roll and an increase in a rolling yield per cycle, thus improving rolling efficiency and quality.

What is claimed is:

1. A low carbon, Ni- Cr- Mo system cast iron roll consisting essentially of in weight percent, from 1.5 to 2.8% C, from 0.2 to 0.7% Si, from 0.6 to 0.8% Mn, from 2.1 to 3.5% Ni, from 1.8 to 2.5% Cr, from 1.1 to 1.5% Mo, the balance being essentially Fe and impurities.

2. A low carbon, Ni- Cr- Mo system cast iron roll consisting essentially of in weight percent, from 1.9 to 2.8% C, from 0.2 to 0.7% Si, from 0.6 to 0.8% Mn, from 2.1 to 3.5% Ni, from 1.8 to 2.5% Cr, from 1.1 to 1.5% Mo, the balance being essentially Fe and impurities.

3. A low carbon, Ni- Cr- Mo system cast iron roll consisting essentially of in weight percent, from 1.9 to 2.2% C, from 0.2 to 0.7% Si, from 0.6 to 0.8% Mn, from 2.5 to 3.4% Ni, from 1.8 to 2.2% Cr, from 1.1 to 1.3% Mo, the balance being essentially Fe, and impurities.

* * * * *